US007540714B1

(12) United States Patent
Dezouche

(10) Patent No.: US 7,540,714 B1
(45) Date of Patent: Jun. 2, 2009

(54) DEVICE FOR BLOCKING A RING FOR AXIALLY RETAINING A BLADE, ASSOCIATED ROTOR DISK AND RETAINING RING, AND ROTOR AND AIRCRAFT ENGINE COMPRISING THEM

(75) Inventor: Laurent Gilles Dezouche, Coudray Montceau (FR)

(73) Assignee: Snecma, Paris (FR)

( * ) Notice: Subject to any disclaimer, the term of this patent is extended or adjusted under 35 U.S.C. 154(b) by 361 days.

(21) Appl. No.: 11/466,994

(22) Filed: Aug. 24, 2006

(30) Foreign Application Priority Data

Aug. 31, 2005 (FR) ..... 05 52636

(51) Int. Cl.
*F01D 5/32* (2006.01)

(52) U.S. Cl. ..... 416/221; 416/220 R

(58) Field of Classification Search ..... 416/219 R, 416/220 R, 221, 248
See application file for complete search history.

(56) References Cited

U.S. PATENT DOCUMENTS 4,033,705 A * 7/1977 Luebering ..... 416/220 R
4,221,542 A 9/1980 Acres et al.
4,730,983 A * 3/1988 Naudet et al. ..... 416/220 R
5,320,492 A 6/1994 Bouru et al.
6,234,756 B1 5/2001 Ress, Jr. et al.
7,290,988 B2 * 11/2007 Boston et al. ..... 416/220 R

FOREIGN PATENT DOCUMENTS

EP 1 443 179 A2 8/2004
FR 2 729 709 7/1996

* cited by examiner

*Primary Examiner*—Christopher Verdier
(74) *Attorney, Agent, or Firm*—Oblon, Spivak, McClelland, Maier & Neustadt, P.C.

(57) ABSTRACT

A device for rotationally blocking a retaining ring on a rotor disk three successive blocking hooks of the disk (10), two cleats of the retaining ring, arranged on either side of a split in the retaining ring. The position of the cleats on the retaining ring is such that, when the retaining ring is in place in a groove situated in the rotor disk, the two cleats are in respective abutment against the first and third blocking hooks, and the split is covered by the second blocking hook.

8 Claims, 2 Drawing Sheets

DEVICE FOR BLOCKING A RING FOR AXIALLY RETAINING A BLADE, ASSOCIATED ROTOR DISK AND RETAINING RING, AND ROTOR AND AIRCRAFT ENGINE COMPRISING THEM

BACKGROUND OF THE INVENTION

The present invention relates to the technical field of rings for axially retaining the blades of a rotor of a turbomachine, in particular of an aircraft engine.

It is aimed at a device for rotationally blocking such a retaining ring.

It is also aimed at a retaining ring equipped with such a rotation-blocking device.

It is additionally aimed at a rotor comprising a retaining ring equipped with such a rotation-blocking device.

It is finally aimed at a turbomachine, for example an aircraft engine, comprising such a retaining ring equipped with such a rotation-blocking device.

Throughout the text, the term "axial" refers to the axial direction of the turbomachine.

DESCRIPTION OF THE PRIOR ART

It is known that a turbomachine rotor is equipped with a disk and with blades carried by the disk, and also with a retaining ring for preventing a displacement of the blades in the axial direction, as described in document FR 2 729 709-A1.

FIG. 1 illustrates such a ring for retaining the blades of a rotor, known from the prior art.

Referring to FIG. 1, a disk 10 of a rotor comprises a disk body 11 and teeth 12 which extend radially from the disk body 11 and are spread around the circumference thereof. The space between two successive teeth 12 forms an axially oriented recess 13. Each tooth 12 is provided with at least one hook 6 which projects in an axial direction and which in this tooth defines an individual groove opening radially inward. In the example illustrated, the teeth 12 are provided with an upstream hook 6 and with a downstream hook 6.

FIG. 2 illustrates a root 14 of a blade 16 inserted into one such recess 13. The two teeth 12 make it possible to contain this blade 16 both circumferentially and radially.

As illustrated in FIG. 2, and in a known manner, a retaining ring 20 is placed in a discontinuous groove 22 which corresponds to the succession of the individual grooves. The presence of the retaining ring 20 in the groove 22 makes it possible to prevent an axial displacement of the blades 16. To facilitate its installation in the groove 22, the retaining ring 20 is open by way of a split 24 which separates the two ends or strands 26 of this ring.

It is generally preferred for the split 24 in the retaining ring 20 to be situated at the level of one of the teeth 12 and not between two adjacent teeth 12 so as to prevent the ends of the retaining ring 20 from coming out of the groove 22. For this purpose, it is known practice to provide the retaining ring 20 with a rotation-blocking device which ensures that the split 24 remains positioned at the level of the one tooth 12, once the retaining ring 20 has been installed in the groove 22.

The device for rotationally blocking the retaining ring 20 according to the prior art, illustrated in FIG. 1, comprises:

- two cleats 30 of the retaining ring 20, which are respectively arranged at the two ends 26 of this ring, on each side of the split 24, and which each have a contact face 32 directed toward the split 24, and

- a stop-forming hook 60 of one of the teeth 12, this stop-forming hook 60 having a front face 42 and two lateral faces 44 which are substantially opposed to one another, the lateral faces 44 being obtained by machining the lateral sides of the stop-forming hook 60.

When the retaining ring 20 is put in place in the groove 22, each contact face 32 of the respective cleats 30 is in abutment against one of the lateral faces 44 of the stop-forming hook 60. Consequently, the split 24 is situated beneath the stop-forming hook 60 and the retaining ring 20 is prevented from turning in the groove 22, with the result that the retaining ring 20 cannot spontaneously come out of the groove 22 during the operation of the turbomachine. It follows that the blades 16 cannot escape from the recesses 13 in which their roots 14 are inserted.

However, the width D of the stop-forming hook 60 is small on account of this stop-forming hook 60 being machined on its two lateral sides. Consequently, the split 24 in the retaining ring 20 is covered by the stop-forming hook 60 over a distance which is equal to the width D of the stop-forming hook 60, and there is a risk that one of the two ends 26, or the two ends 26, of the retaining ring 20 might escape from the individual groove of the tooth 12 having the stop-forming hook 60. This risk is increased when the split 24 in the retaining ring 20 is oriented obliquely with respect to the circumferential direction of the retaining ring 20, and not perpendicularly to this direction. Consequently, this might result in an axial displacement of a blade 14, and consequently in the loss of this blade 14.

SUMMARY OF THE INVENTION

The present invention provides a device for rotationally blocking a ring for retaining the blades of a rotor of a turbomachine, which overcomes the abovementioned disadvantage inherent in the rotation-blocking device of the prior art.

According to a first aspect, the invention relates to a device for rotationally blocking a ring for retaining blades on a rotor disk of a turbomachine in a substantially axial direction of said turbomachine, said rotor disk being provided with hooks spread around its circumference and defining a groove for accommodating said retaining ring, and said retaining ring being provided with a split.

The blocking device comprises:

- in succession a first blocking hook, a second blocking hook and a third blocking hook of said rotor disk, and
- two cleats of said retaining ring, arranged on a ring face on either side of said split.

The position of said cleats on said retaining ring is such that, when said retaining ring is in place in said groove, said two cleats are in respective abutment against said first blocking hook and against said third blocking hook, and said split is covered by said second blocking hook.

As will become apparent from the remainder of the description, the term "blocking hook" covers two functions performed by one or more of these three hooks: a stop function for a cleat and a function of covering the split.

Preferably, said first and third blocking hooks are each provided with a check face on their side which is opposite to the side facing said second blocking hook, said cleats of said retaining ring are each provided with a contact face oriented toward said split, and said check faces cooperate with said contact faces in order to bring said cleats into abutment against said first and third blocking hooks.

In particular, said groove has two walls, one internal wall which is closer to the rotor disk and one external wall which is further from the rotor disk, and each check face is situated on the corresponding blocking hook and extends in the axial direction, starting from the free surface of said blocking hook and continuing as far as the internal wall of said groove.

According to one variant embodiment, said check faces are oriented in a radial plane of said rotor disk.

According to another variant embodiment, said check faces are oriented in an oblique plane with respect to a radial plane of said rotor disk.

According to a second aspect, the invention relates to a turbomachine rotor disk, this disk being provided with hooks spread around its circumference and comprising a first blocking hook, a second blocking hook and a third blocking hook in succession, in which disk said first and third blocking hooks are each provided with a check face on their side which is opposite to the side facing said second blocking hook.

In a known manner, said hooks define a groove oriented radially inward and having two walls, one internal wall which is closer to the rotor disk and one external wall which is further from the rotor disk. According to the invention, each check face is situated on the corresponding blocking hook and extends in the axial direction, starting from the free surface of said blocking hook and continuing as far as the internal wall of said groove.

According to one variant embodiment, said check faces are oriented in a radial plane of said rotor disk.

According to another variant embodiment, said check faces are oriented in an oblique plane with respect to a radial plane of said rotor disk.

According to a third aspect, the invention relates to a ring for retaining the blades of a turbomachine rotor, intended to be combined with a rotor disk according to the first aspect of the invention, comprising a split and two cleats which are arranged on a ring face on either side of said split, and in which said cleats are spaced apart by an angular gap at least equal to three times the angular pitch separating two successive blades.

According to a fourth aspect, the invention relates to a disk/ring assembly, comprising a retaining ring provided with a split, and comprising a rotor disk provided with hooks spread around its circumference and defining a groove for accommodating said retaining ring, wherein said rotor disk comprises a first blocking hook, a second blocking hook and a third blocking hook in succession, wherein said retaining ring comprises two cleats arranged on a ring face on either side of said split, and wherein the position of said cleats on said retaining ring is such that, when said retaining ring is in place in said groove, said two cleats are in respective abutment against said first blocking hook and against said third blocking hook, and said split is covered by said second blocking hook.

Preferably, said first and third blocking hooks are each provided with a check face on their side which is opposite to the side facing said second blocking hook, said cleats of said retaining ring are each provided with a contact face oriented toward said split, and said check faces cooperate with said contact faces in order to bring said cleats into abutment against said first and third blocking hooks.

According to a fifth aspect, the invention relates to a turbomachine rotor comprising a blocking device according to the first aspect of the invention and/or a rotor disk according to the second aspect of the invention and/or a retaining ring according to the third aspect of the invention and/or a disk/ring assembly according to the fourth aspect of the invention.

According to a sixth aspect, the invention relates to a turbomachine, for example an aircraft engine, comprising a blocking device according to the first aspect of the invention and/or a rotor disk according to the second aspect of the invention and/or a retaining ring according to the third aspect of the invention and/or a disk/ring assembly according to the fourth aspect of the invention.

BRIEF DESCRIPTION OF THE DRAWINGS

The invention will be better understood on reading the detailed description below of embodiments of the invention, which are given by way of illustration and impose no limitation, with reference to the appended drawings, in which.

DESCRIPTION OF THE PREFERRED EMBODIMENTS

Figure 1:
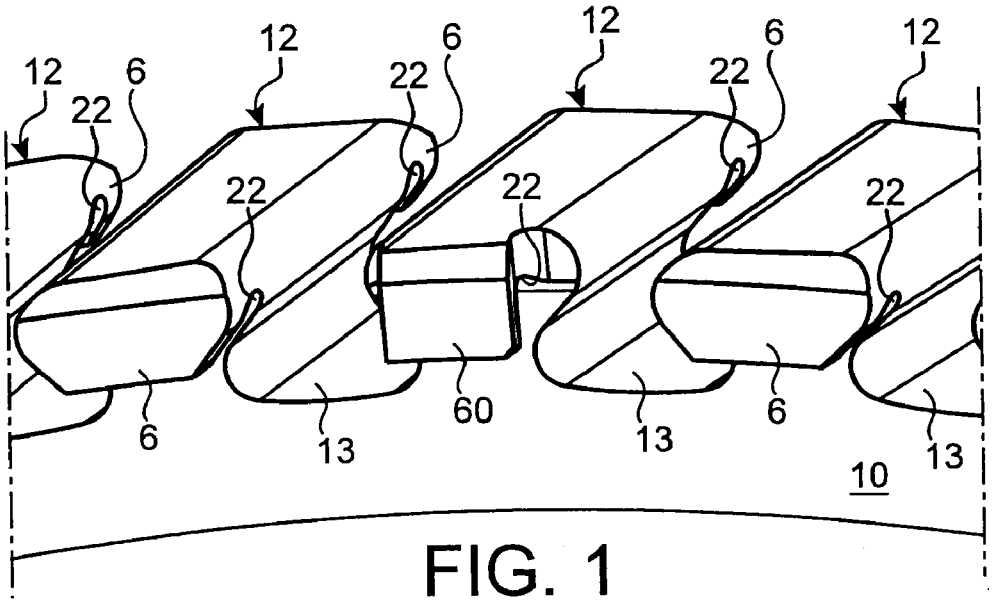
FIG. 1 Prior Art
FIG. 1, already described, shows a perspective view of a portion of a rotor disk adapted for a device for rotationally blocking a ring for retaining blades, according to the prior art.

The rotation-blocking device according to the invention, illustrated in FIGS. 3 and 4, will be described only in terms of its differences over the rotation-blocking device according to the prior art, illustrated in FIGS. 1 and 2. In the figures, identical references denote identical features.

To simplify the detailed description which follows, the retaining ring will be simply referred to as "ring" and the first, second and third blocking hooks will be simply referred to as "first hook", "second hook" and "third hook", respectively.

Figure 3:
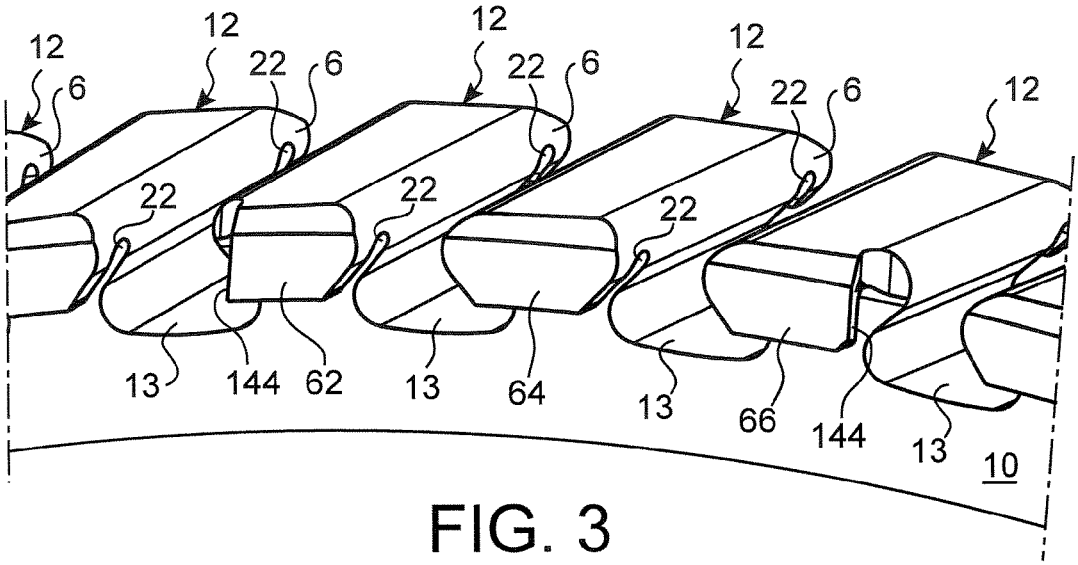
FIG. 3 shows a perspective view of a portion of a rotor disk adapted for a device for rotationally blocking a ring for retaining moving blades, according to the invention.
Figure 4:
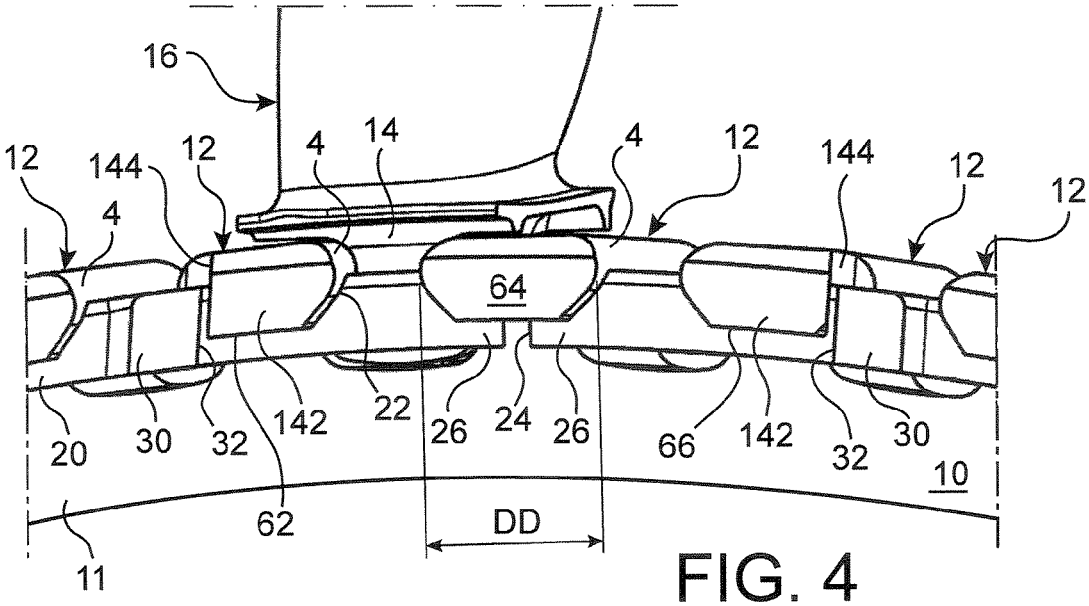
FIG. 4 shows a perspective view of a device for rotationally blocking a ring for retaining blades of a turbomachine rotor, according to the invention.

Referring to FIGS. 3 and 4, a disk 10 of a rotor comprises teeth 12 which extend radially from its circumference and are spread around this circumference. The space between two successive teeth 12 forms an axially oriented recess 13 in which is inserted a root 14 of a blade 16. These two successive teeth 12 have shapes and dimensions which make it possible to contain, both circumferentially and radially, the blade 16 installed between them in the recess 13.

The teeth 12 have a projecting portion 4 which protrudes from the disk 10 in the axial direction toward the upstream side and/or a projecting portion 4 which protrudes from the disk 10 in the axial direction toward the downstream side. Within each projecting portion 4 is formed an individual groove which opens radially inward, the free end of each projecting portion 4 beyond the individual groove with respect to the disk body 11 forming a hook 6 oriented radially inward. Each individual groove has two walls, one internal wall which is closer to the rotor disk 10 and one external wall which is further from the rotor disk 10.

The succession of the individual grooves forms a discontinuous groove 22 in which ring 20 is arranged. The ring 20 in the groove 22 constitutes an axial stop which makes it possible to prevent an axial displacement of the blades 16. To facilitate its installation in the groove 22, this ring 20 is open by way of a split 24 which separates its two ends 26 from one another.

Figure 2:
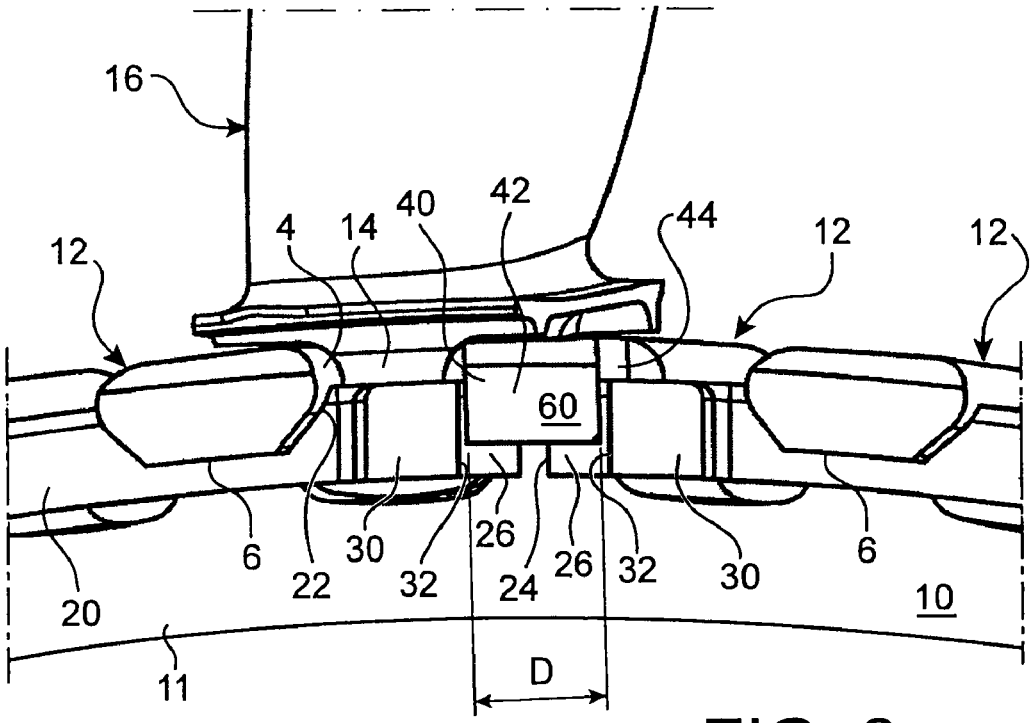
FIG. 2 Prior Art
FIG. 2, already described, shows a perspective view of a device for rotationally blocking a ring for retaining blades of a turbomachine rotor, according to the prior art.

The ring 20 comprises two cleats 30 positioned on the same ring face, on the opposite face to the face of the ring which faces the rotor disk 10, in the example illustrated in FIG. 2.

Preferably, each cleat 30 is produced in the following way. Two cuts are made in the ring 20 so as to allow removal of a ring sector having a given dimension in the circumferential direction of said ring 20 and the same dimension as the remainder of the ring 20 in the axial direction thereof. The removed sector is replaced by a piece having the same dimension in the axial direction and the same dimension in the circumferential direction, but having a greater thickness. This piece is fastened to the remainder of the ring 20 by welding so as to reconstitute a closed ring 20. The cleat 30 is then machined into said piece having a greater thickness than the remainder of the ring 20. Such a procedure makes it possible to carry out precise machining of the cleats 30, ensuring their dimensions and their position on the ring 20.

The split 24 is made in the ring 20 following the production of the two cleats 30. It is positioned such that the two cleats 30 are arranged toward one of the ends 26 of the ring 20, on either side of the split 24, at a specified distance from this split. Preferably, the two cleats 30 are spaced apart by an angular gap at least equal to three times the angular pitch of the blades 16. This angular pitch is defined as the angular gap between the center planes of two successive recesses 13.

Each cleat 30 comprises a contact face 32 oriented toward the split 24 in the ring 20.

Among the hooks 6 there are, in succession, a first hook 62, a second hook 64 and a third hook 66.

The second hook 64 has a geometry similar to the geometry of the hooks 6 of the prior art.

The first hook 62 and the third hook 66 have a geometry which is modified in relation to that of the hooks 6. Each of the first and third hooks 62, 66 has a front face 142 which is the face of its free surface, and a lateral face 144 which is substantially perpendicular to the front face 142. The lateral face 144 of the first hook 62, or of the third hook 66, respectively, extends from the front face 142 of said hook 62, 66 as far as the internal wall of the individual groove of said hook 62, 66. Preferably, the lateral face 144 of the first hook 62 is obtained by a machining operation on its lateral side which is opposite to its lateral side which faces the third hook 66. Analogously, the lateral face 144 of the third hook 66 is obtained by a machining operation on its lateral side which is opposite to its lateral side which faces the first hook 62.

In other words, each of the corresponding teeth 12 is terminated by a hook 62, 66 which has a lateral face 144 on its side which is opposite to its side facing the other hook 66, 62, said lateral face being set back circumferentially.

In the example illustrated in FIG. 2, the lateral faces 144 are oriented in a radial plane of the rotor disk 10.

The position of the two cleats 30 on the ring 20 is established in a suitable manner, preferably depending on the dimensions and distances of the hooks 62, 64, 66 of the rotor disk 10. This position may be defined by their respective distances with respect to the respective ends 26 of the ring 20 or by the angular gap which separates them. For reasons associated with ease of manufacture, it is preferred, but not necessary, for the two cleats 30 to be arranged symmetrically on either side of the split 24.

Given a suitable relative position of the two cleats 30 on the ring 20, when the ring 20 is put in place in the groove 22, the contact face 32 of one of the cleats 30 is in abutment against the lateral face 144 of the first hook 62, and the contact face 32 of the other cleat 30 is in abutment against the lateral face 144 of the third hook 66. The lateral faces 144 are respective check faces of the first hook 62 and of the third hook 66, which cooperate with the respective contact faces 32 of the two cleats 30 of the ring 20. The two ends 26 of the ring 20 and the split 24 are then situated beneath the second hook 64.

The ring 20 is thus prevented from turning in the groove 22. Consequently, the ring 20 cannot escape from the groove 22 during the operation of the turbomachine. It follows that the blades 16 cannot escape in the axial direction from the recess 13 in which they are inserted.

The invention which has just been described therefore makes it possible to prevent the ring 20 from turning in the groove 22. It has the advantage that the split 24 in the ring 20 is positioned beneath a hook and not between two hooks. Furthermore, the split 24 is positioned beneath the second hook 64, which does not have a set back lateral face, and therefore has a width DD which is not small as was the possibility with the width D of the hook 60 of the blocking device of the prior art. Consequently, the risks of the ends of the ring 20 coming out of the groove 22 are small.

With the device for rotationally blocking the ring 20 according to the invention, the actual blocking function (by bringing contact faces 32 of the cleats into abutment against the check faces 144 of the first and third hooks 62, 66) and the function of covering the split 24 are not provided by a single disk hook, as was the case with the blocking device of the prior art.

The invention is not limited to the embodiment which has just been described. In the example illustrated in FIG. 4, the split 24 is perpendicular to the circumferential direction of the ring 20, but it could be oblique without departing from the scope of the invention.

In the example illustrated in FIGS. 3 and 4, the check faces are oriented in a radial direction of the rotor disk 10, but they could be oriented in an oblique direction with respect to a radial direction of the rotor disk 10, without departing from the scope of the invention.

In the example illustrated in FIGS. 3 and 4, the recesses 13 in which are inserted the roots 14 of the blades 16 are oriented axially, but the invention equally applies to configurations in which the direction of the recesses forms an angle with the axial direction of the turbomachine.

The invention claimed is:

1. A device for rotationally blocking a ring for retaining blades on a rotor disk of a turbomachine in a substantially axial direction of said turbomachine, said rotor disk being provided with hooks spread around its circumference and defining a groove for accommodating said retaining ring, including in succession a first blocking hook, a second blocking hook and a third blocking hook, said second blocking hook being situated between said first and third blocking hooks, and said retaining ring being provided with a split and with two cleats arranged on a ring face on either side of said split, wherein the position of said cleats on said retaining ring is such that, when said retaining ring is in place in said groove, said two cleats are in respective abutment against said first blocking hook and against said third blocking hook, and said split is covered by said second blocking hook.

2. The rotation-blocking device as claimed in claim 1, wherein:

said first and third blocking hooks are each provided with a check face on their side which is opposite to the side facing said second blocking hook, and said cleats of said retaining ring are each provided with a contact face oriented toward said split, and said check faces cooperate with said contact faces in order to bring said cleats into abutment against said first and third blocking hooks.

3. The blocking device as claimed in claim 2, in which said groove has two walls, one internal wall which is closer to the rotor disk and one external wall which is further from the rotor disk, wherein each check face is situated on the corresponding blocking hook and extends in the axial direction, starting from a free surface of said blocking hook and continuing as far as the internal wall of said groove.

4. The blocking device as claimed in claim 2, wherein said check faces are oriented in a radial plane of said rotor disk.

5. A disk/ring assembly of a turbomachine, comprising a retaining ring provided with a split, and comprising a rotor disk provided with hooks spread around its circumference and defining a groove for accommodating said retaining ring, wherein said rotor disk comprises a first blocking hook, a second blocking hook and a third blocking hook in succession, wherein said retaining ring comprises two cleats arranged on a ring face on either side of said split, and wherein the position of said cleats on said retaining ring is such that, when said retaining ring is in place in said groove, said two cleats are in respective abutment against said first blocking hook and against said third blocking hook, and said split is covered by said second blocking hook.

6. The disk/ring assembly as claimed in claim 5, wherein said first and third blocking hooks are each provided with a check face on their side which is opposite to the side facing said second blocking hook, said cleats of said retaining ring are each provided with a contact face oriented toward said split, and said check faces cooperate with said contact faces in order to bring said cleats into abutment against said first and third blocking hooks.

7. A turbomachine rotor, which comprises a blocking device as claimed in claim 1.

8. An aircraft engine, which comprises a blocking device as claimed in claim 1.

* * * * *